United States Patent [19]

Baldyga et al.

[11] 3,977,587

[45] Aug. 31, 1976

[54] CONVEYOR FEED MECHANISM

[75] Inventors: Joseph W. Baldyga, Mount Clemens; Thomas M. Cairns, Birmingham, both of Mich.

[73] Assignee: Diamond Die & Mold Co., Mount Clemens, Mich.

[22] Filed: Mar. 28, 1975

[21] Appl. No.: 563,073

[52] U.S. Cl. ..... 226/74

[51] Int. Cl.[2] ..... B65H 17/38

[58] Field of Search ..... 226/74, 75, 62

[56] References Cited

UNITED STATES PATENTS

| | | | |
|---|---|---|---|
| 1,927,062 | 9/1933 | Conn | 226/74 |
| 2,277,693 | 3/1942 | Dybvig | 226/75 |
| 3,732,899 | 5/1973 | Schindler | 226/74 X |
| 3,858,784 | 1/1975 | Diepeveen | 226/62 X |

*Primary Examiner*—Richard A. Schacher

*Attorney, Agent, or Firm*—Whittemore, Hulbert & Belknap

[57] ABSTRACT

Feed mechanism for a continuous strip having a series of uniformly spaced holes in which an endless conveyor having a multiplicity of laterally projecting pins is adapted to engage one side of the strip with a plurality of pins extending simultaneously into a corresponding plurality of holes, together with means for driving the conveyor so as to advance the continuous strip.

5 Claims, 3 Drawing Figures

CONVEYOR FEED MECHANISM

BRIEF SUMMARY OF THE INVENTION

The present invention relates to advancing strip material and finds a particular field of utility in advancing electrical terminal stock. This terminal stock is formed from thin conducting metal and along at least one edge thereof the strip is maintained in continuous form. The remainder of the strip however is cut out to provide a multiplicity of terminal forming portions having edges which are bent upwardly to receive the bared ends of electrical conductors. The terminal forming portions are crimped by suitable die and punch mechanism to form an electrical terminal and the terminal as thus formed is severed from the continuous strip material.

Reference is made to prior U.S. Pat. No. 3,578,230 which discloses feeding means for advancing similar terminal forming strip material except that in the patented construction the terminal forming strip material includes continuous strip at both sides and the feeding means is engageable with the terminal forming portions intermediate the strips.

The present invention is particularly useful where the continuous terminal stock comprises a single continuous strip at one side, together with a plurality of terminal forming portions which project laterally from the strip but which are not interconnected at the end remote from the aforesaid strip. With this construction the terminal forming portions of the strip are not adequately supported to be engaged by a pusher element.

The continuous strip material in the present instance is provided with a series of equally spaced openings, the spacing of the openings being equal to the spacing of adjacent terminal forming portions of the strip.

In order to insure positive advance of the continuous strip of terminal stock, an endless conveyor is provided having a straight run adapted to contact one side of the strip. Conveniently, the conveyor may be formed of chains, the links of which are provided at a spacing equal to the spacing of the openings in the continuous strip material. Each link of the chain is provided with a pin extending completely therethrough and extending beyond opposite sides of the link. The appropriate ends of the pins are pointed and are adapted to be received in the openings in the strip so that as the conveyor is advanced a multiplicity of pins are engaged in openings therein and provide for positive feeding movement of the strip as the conveyor is advanced incrementally.

The opposite ends of the pins project beyond the other side of the links and form feeding abutments which are engageable by a reciprocating feed member biased toward the side of the conveyor at which the feed abutments appear. The feed member has a feeding portion biased into engagement with the conveyor, the feeding portion having a cam surface engageable with an abutment as the feed member is moved in a return stroke so that the feeding portion is cammed over the feeding abutment. On the forward or feeding stroke however, the feeding member has a feeding surface which engages with the abutment over which it passed on the return stroke and the feeding member therefore causes an incremental forward movement of the conveyor and hence of the continuous strip of the terminal stock a distance equal to the spacing between adjacent feeding abutments and accordingly, equal to the spacing between adjacent terminal forming portions of the stock.

The parts are arranged so that each incremental advance of the stock brings a terminal forming portion into registration with a die and punch combination. The operator then places the bared end of a conductor in proper relation to the terminal forming portion and a press is operated to relatively move the die and punch so as to crimp the terminal forming portion tightly around the bared end of the conductor. At the same time, the terminal forming portion is severed from the strip.

DETAILED DESCRIPTION

Figure 1:
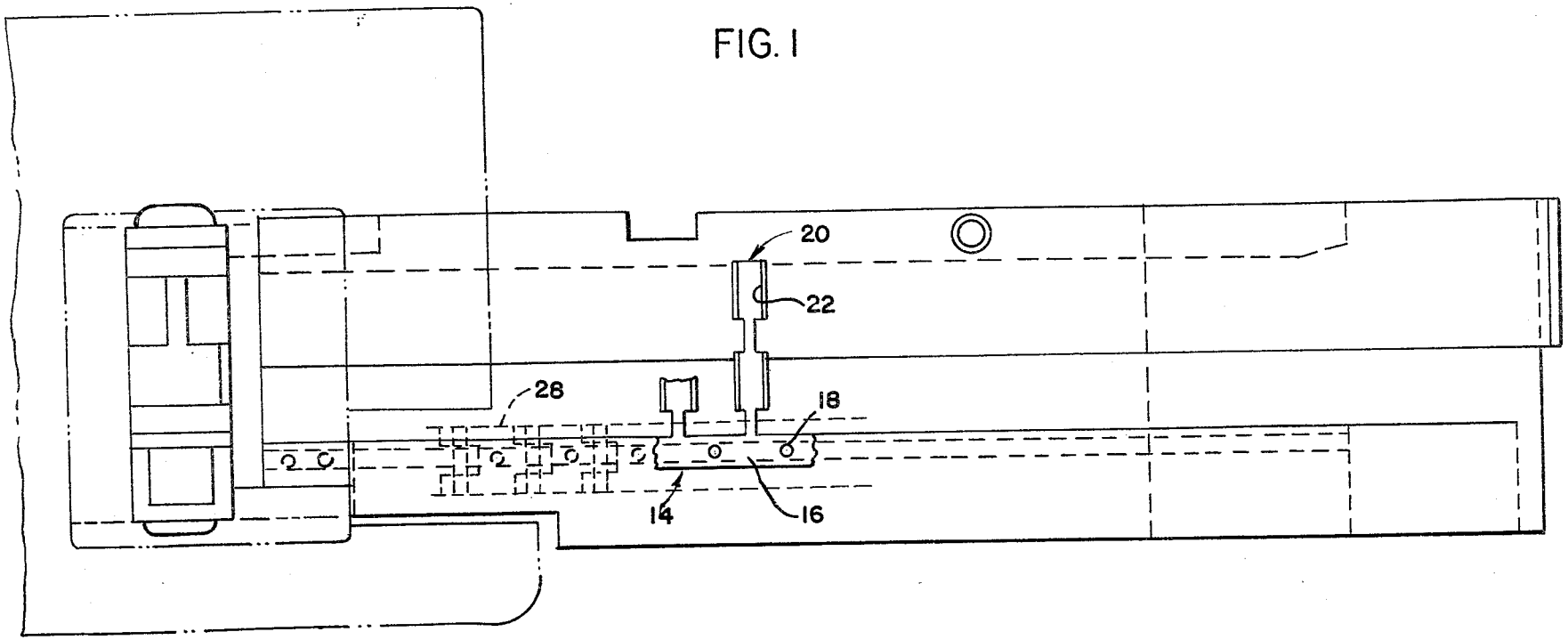
FIG. 1 is a plan view of the conveyor feed mechanism.
Figure 3:
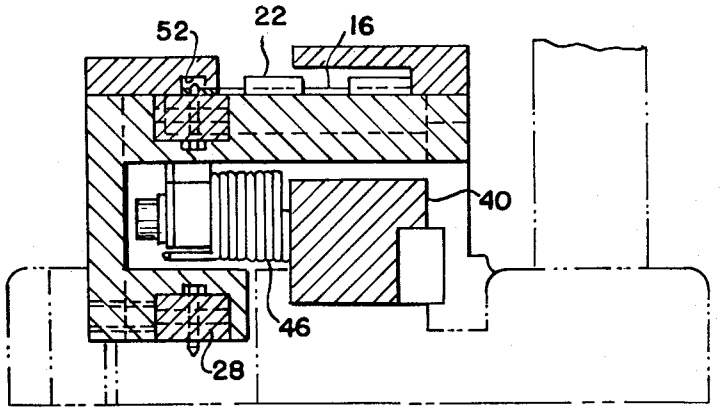
FIG. 3 is a sectional view on the line 3—3, FIG. 1.
Figure 2:
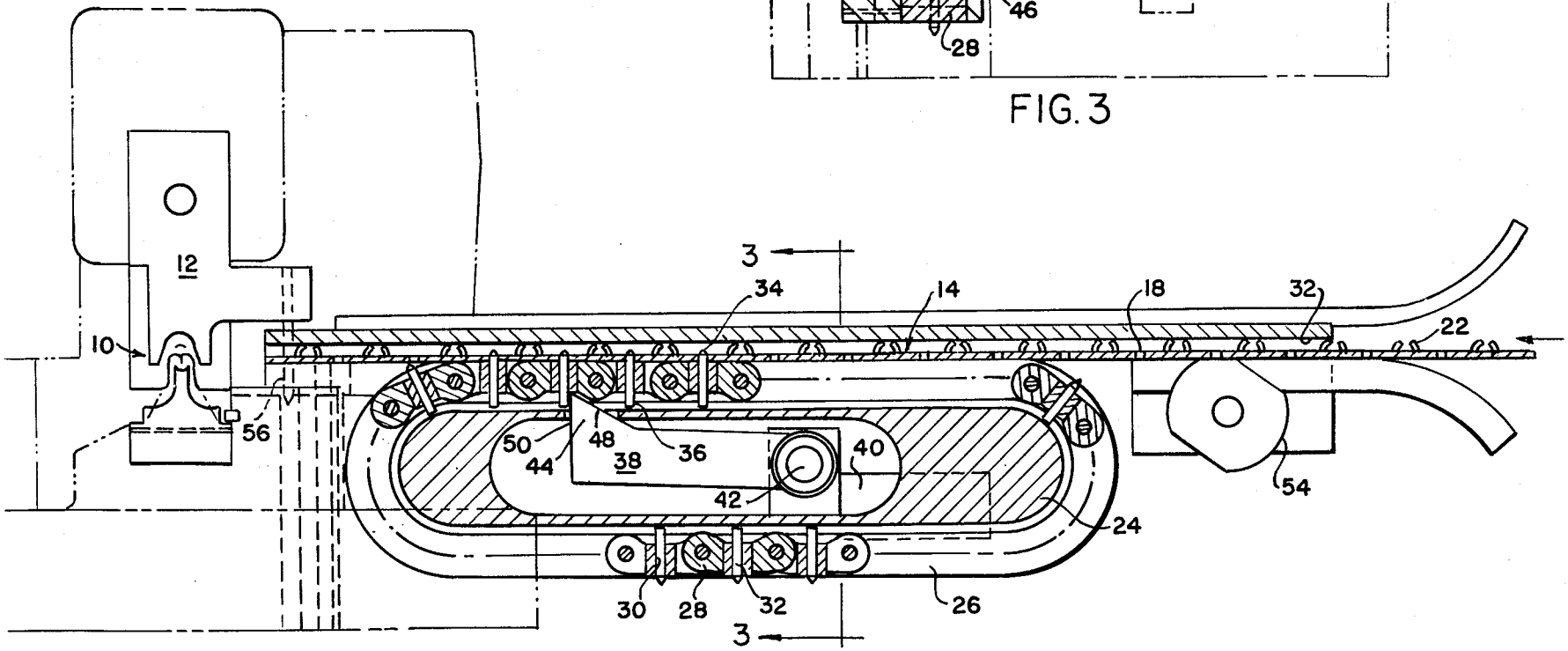
FIG. 2 is a side elevation thereof, partly in section.

The mechanism comprises the crimping mechanim including a die and punch indicated more or less diagrammatically at 10, in which a ram (not shown) moves the upper element 12 of the mechanism downwardly so as to crimp the terminal forming portion of the stock onto the end of an electrical conductor suitably positioned in the punch and die mechanism. The continuous strip material is indicated generally at 14 and as best seen in FIG. 1, it comprises a continuous strip 16 provided with equally spaced openings 18 therein. The terminal stock is formed from a relatively wide strip of conducting metal which is cut away to provide a series of equally spaced terminal forming portions one of which is indicated in its entirety at 20. It will be understood that many specifically different terminal forming portions may be provided and that illustrated herein is merely by way of example. The edges of the terminal forming portions are bent upwardly as indicated at 22, better illustrated in FIG. 3.

As will be apparent from an inspection of FIG. 1, the terminal forming portions 20 are connected to the continuous strip 16 only at one end and accordingly, are not suitable for direct engagement with a feeding member. On the other hand, it has been found unsatisfactory to provide a reciprocating feeding member having a pointed portion for example engageable in one of the holes or openings 18.

In accordance with the present invention, feed means are provided comprising an elongated support 24 around which is trained an endless conveyor 26 made up of a multiplicity of chain links 28 each of which is provided with a through opening 30 receiving a pin 32 having a pointed end 34 projecting beyond the outer side of the conveyor and adapted to enter one of the openings 18 in the continuous strip 16. The pins 32 have their other ends projecting beyond the inner side of the conveyor 26 and these inwardly projecting ends constitute feeding abutments 36.

Feed means are provided comprising a movable feed member 38 which is pivoted to a reciprocating carriage 40 as indicated at 42. The feed member 38 is in the form of a lever having a feeding portion 44 at its free end, and this is biased toward the feeding abutments 36 by resilient means herein illustrated as comprising a coil spring 46.

The feeding portion 44 of the lever 38 has an inclined camming portion 48 which is engageable with the inner abutment forming end 36 of a pin on the return stroke of the feed carriage 40 to the right. This causes the lever 38 to be biased downwardly so that its feeding portion passes idly over the projection 36. The feed portion 44 is provided with a feeding surface 50, which on the feeding stroke of the carriage 40 to the left engages the end portion 36 of the pin over which the feeding portion passed on its return stroke and advances the conveyor and hence, the terminal stock a distance equal to the spacing of the terminal forming portions thereof.

Reciprocating movement of the carriage 40 and feeding member 38 may be suitably coordinated with the vertical movements of the press 12 and this may conveniently take the form of the mechanism illustrated in detail in prior U.S. Pat. No. 3,578,230. It will be observed that in the patent a feeding lever is provided having a nose which includes camming and feeding surfaces biasing the lever to cause it to pass idly over a terminal feeding portion on the return stroke but to engage such portion on the feeding stroke.

Associated with the continuous strip 18 is a guide channel 52 and preferably, there is provided a wedging cam 54 lightly biased in a clockwise direction by suitable means (not shown). The cam accordingly permits substantially free movement of the continuous strip 16 to the left but wedges it against movement to the right.

With the illustrated construction it will be observed that the relatively narrow, fragile continuous strip 16 is engaged simultaneously by a plurality of pins, in the illustrated embodiment eight pins are shown as engageable simultaneously in openings. Accordingly, as the relatively rugged chain conveyor is advanced step-by-step as a result of reciprocation of the feed carriage 40 and movable feed member 38, the terminal stock is advanced incrementally without subjecting the relatively fragile laterally extending terminal forming portions 20 to any stress whatever.

A final locator pin 56 is carried by movable ram 12, and enters an opening 18 in strip 16 directly adjacent punch and die assembly 10. This insures precise location and positive holding of a terminal forming portion during the actual crimping thereof.

What we claim as our invention is:

1. Feed apparatus for feeding terminal stock to an applicator, in which the terminal stock is in the form of a continuous metal strip having uniformly spaced terminal forming portions extending laterally from the strip and having uniformly spaced openings coordinated with the spacing between terminal forming portions, stock feed means comprising an endless conveyor in the form of a chain made up of a succession of pivotally interconnected links, said chain having a straight portion adapted to extend along the continuous strip, pins extending through and projecting beyond both sides of the links and rigidly fixed to said links and forming a first series of rigid projections at one side of said chain spaced thereon and dimensioned to enter the openings in the strip and a second series of rigid projections at the opposite side of said chain, and feed means engageable with the projections of said second series for advancing said chain step-by-step in increments equal to the spacing between the openings in the strip and between successive terminal forming portions.

2. Feed apparatus for feeding terminal stock to an applicator, in which the terminal stock is in the form of a continuous metal strip having uniformly spaced terminal forming portions extending laterally from the strip and having uniformly spaced openings coordinated with the spacing between terminal forming portions, stock feed means comprising an endless conveyor having a straight portion adapted to extend along the continuous strip, a first series of projections on said conveyor spaced thereon and dimensioned to enter the openings in the strip, and feed means for advancing said conveyor step-by-step in increments equal to the spacing between the openings in the strip and between successive terminal forming portions, said conveyor having a second series of equally spaced projections on the side opposite said first series, said feed means comprising a movable feed member having a feed portion engageable with the projections of said second series, means yieldably urging said feed portion into engagement with the side of said conveyor having said second series of projections thereon, means for reciprocating said feed member longitudinally of the straight portion of said conveyor in feed and return strokes, said feed portion being shaped to slide over a projection of said second series on the return stroke thereof but to engage a projection in feeding relation on the feed stroke thereof.

3. Apparatus as defined in claim 2 in which said feed means comprises a reciprocable feed carriage, and said feed member comprises a lever pivoted to said carriage and having a free end constituting said feed portion thereof.

4. Feed apparatus for feeding terminal stock to an applicator, in which the terminal stock is in the form of a continuous metal strip having uniformly spaced terminal forming portions extending laterally from the strip and having uniformly spaced openings coordinated with the spacing between terminal forming portions, stock feed means comprising an endless conveyor having a portion adapted to extend along the continuous strip, pins extending through and projecting beyond both sides of said conveyor to form a first series of projections at one side of said conveyor spaced therein and dimensioned to enter the openings in the strip and a second series of projections at the opposite side of said conveyor, feed means engageable with the projections of said second series for advancing said conveyor step-by-step in increments equal to the spacing between the openings in the strip and between successive terminal forming portions, in which the feed means comprises a movable feed member having a feed portion engageable with the projections of said second series, means yieldably urging said feed portion into engagement with the side of said conveyor having said second series of projections thereon, means for reciprocating said feed member longitudinally of a portion of said conveyor in feed and return strokes, said feed portion being shaped to slide over a projection of said second series on the return stroke thereof but to engage a projection in feeding relation on the feed stroke thereof.

5. Apparatus as defined in claim 4 in which said feed means comprises a reciprocable feed carriage, and said feed member comprises a lever pivoted to said carriage and having a free end constituting said feed portion thereof.

* * * * *